US009423168B1

(12) United States Patent
Rosso

(10) Patent No.: US 9,423,168 B1
(45) Date of Patent: Aug. 23, 2016

(54) PORTABLE COOLER SYSTEM

(71) Applicant: Michael J. Rosso, Colleyville, TX (US)

(72) Inventor: Michael J. Rosso, Colleyville, TX (US)

( * ) Notice: Subject to any disclaimer, the term of this patent is extended or adjusted under 35 U.S.C. 154(b) by 0 days.

(21) Appl. No.: 14/260,468

(22) Filed: Apr. 24, 2014

(51) Int. Cl.

| | |
|---|---|
| ***F25D 3/08*** | (2006.01) |
| ***F25D 23/02*** | (2006.01) |
| ***B65D 43/16*** | (2006.01) |
| ***B65D 25/02*** | (2006.01) |

(52) U.S. Cl.
CPC *F25D 3/08* (2013.01); *B65D 25/02* (2013.01); *B65D 43/16* (2013.01); *F25D 23/028* (2013.01)

(58) Field of Classification Search
CPC ..... F25D 3/08; F25D 23/028; B65D 25/02; B65D 25/108; B65D 43/16
USPC ..... 220/503, 505, 507
See application file for complete search history.

(56) References Cited

U.S. PATENT DOCUMENTS

| | | | | |
|---|---|---|---|---|
| 5,058,397 | A * | 10/1991 | MacDonald | A61J 1/165 62/371 |
| 5,095,718 | A * | 3/1992 | Ormond | A45F 3/04 206/427 |
| 7,269,970 | B2 * | 9/2007 | Robertson | A47F 3/0443 62/457.5 |
| 8,505,726 | B1 * | 8/2013 | Woog | F25D 31/007 206/457 |
| 2004/0025530 | A1 * | 2/2004 | Perrins | A45C 11/20 62/457.5 |
| 2008/0029526 | A1 * | 2/2008 | Campbell | A47G 23/0266 220/737 |

* cited by examiner

*Primary Examiner* — Stephen Castellano
(74) *Attorney, Agent, or Firm* — Eldredge Law Firm; Richard G. Eldredge

(57) ABSTRACT

An ice cooler system includes a body configured to form a fluidly sealed cavity, a first row of tubes and a second row of tube in fluid communication with the fluidly sealed cavity, the first row and the second row of tubes being configured to receive beverages, and a door pivotally attached to the body and in fluid communication with the fluidly sealed cavity. The door is configured to allow ice to pass therethrough to the cavity, which in turn is placed in contact with the first row and the second row of tubes.

4 Claims, 6 Drawing Sheets

PORTABLE COOLER SYSTEM

BACKGROUND

1. Field of the Invention

The present invention relates generally to devices used to cool items, and more specifically, to a portable cooler system such as an ice chest.

2. Description of Related Art

Portable cooler systems, e.g., ice chests, are well known in the art and are effective means to chill food and beverages for an extended period of time. In one exemplary embodiment, as shown in FIG. 1, a conventional ice chest 101 includes an insulated body 103 that forms a cavity 105 to carry food, beverage, and the like along with ice for cooling. During use, the user places ice within cavity 105 to chill the items also placed therein. A lid 107 is pivotally attached to body 103 and is configured to seal cavity 105 to maintain the chilled temperature.

Common disadvantages with ice chest 101 include the arduous process of sifting through the ice to locate a beverage, sandwich, and the like, which in turn results in the hands becoming cold and wet and the food becoming soggy due to package leakage.

Although great strides have been made in the area of portable cooler systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
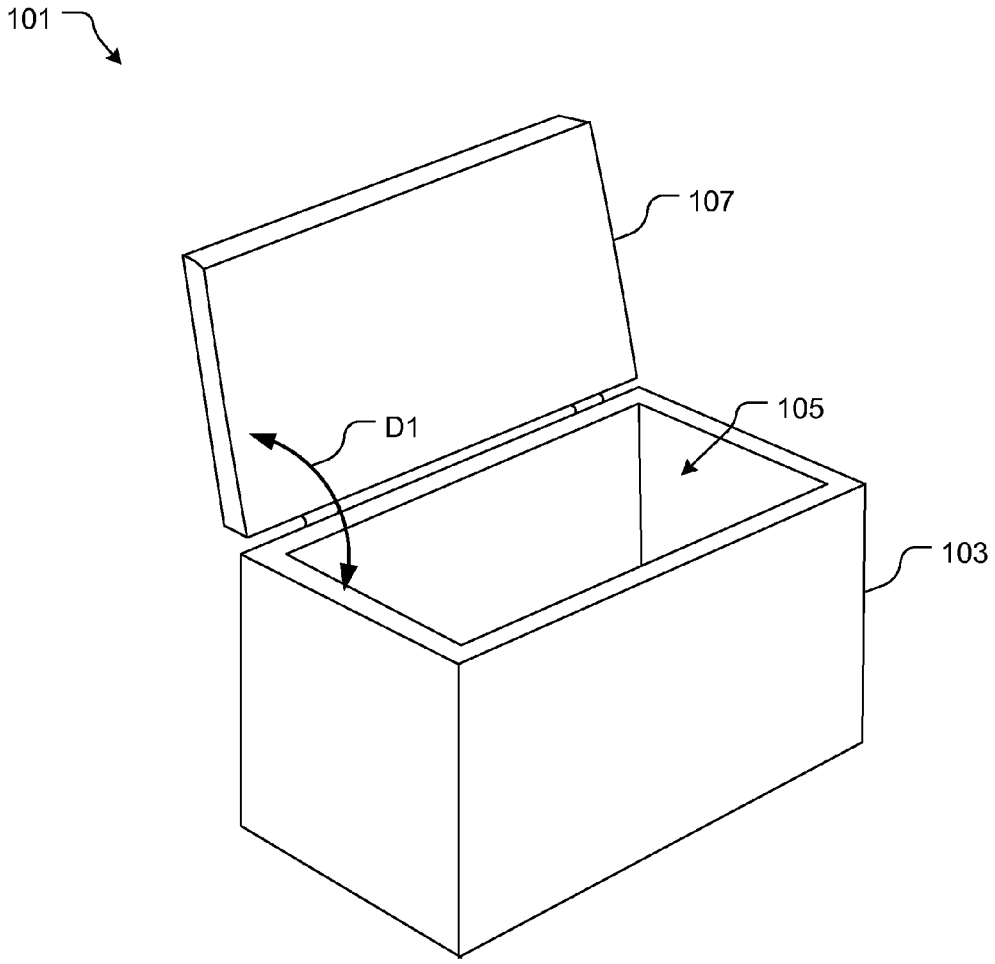
FIG. 1 (Prior Art)
FIG. 1 is an oblique view of a conventional cooler system.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional systems. Specifically, the cooler system of the present application includes a body that forms a fluidly sealed cavity in fluid communication with a plurality of tubes configured to store beverages therein. The tubes are in communication with the ice stored within the cavity for heat transfer but keep the fluid from reaching the contents stored within the tubes. These and other unique features of the cooler system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

Figure 2:
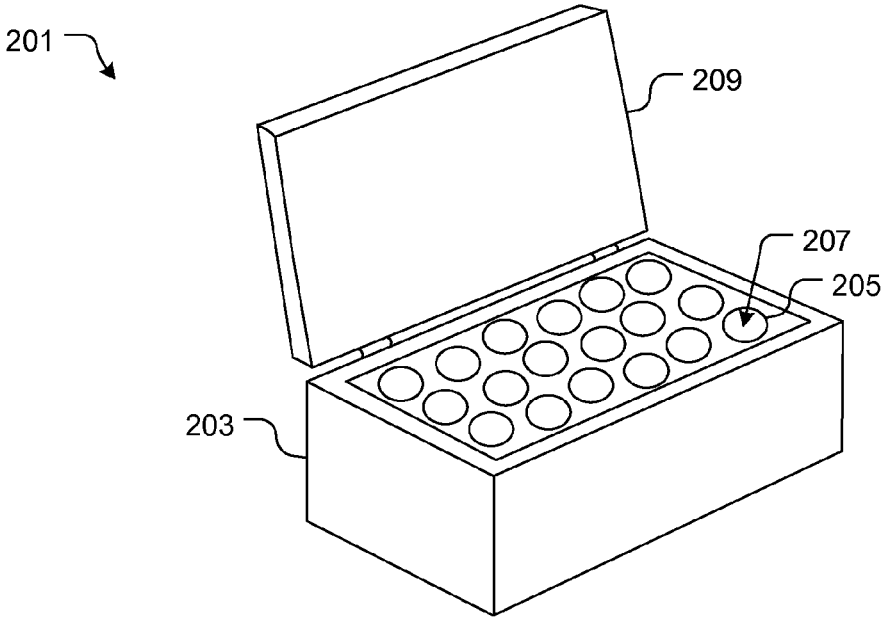
FIG. 2 is an oblique view of a cooler system in accordance with a preferred embodiment of the present application.

Referring now to the drawings wherein like reference characters identify corresponding or similar elements throughout the several views, FIG. 2 depicts a side view of a cooler system 201 in accordance with a preferred embodiment of the present application. It will be appreciated that system 201 overcomes at least one of the above-listed problems commonly associated with the conventional cooler systems.

In the contemplated embodiment, system 201 preferably includes one or more of a body 203 that forms a fluidly sealed cavity 401 (see, e.g., FIG. 4) for retaining ice therein. Positioned within cavity 401 are a plurality of cylindrical shaped tubes 205 that form an hollow interior area 207 for receiving a beverage. It should be noted that only one of the tubes 205 is labeled for the sake of viewing clarity. Also, it should be noted that the tubes 205 are positioned three in each row and each row is offset from each other. This feature helps facilitate ice flowing between the tubes; however, it is also contemplated having the tubes in a non-offset pattern in alternative embodiments.

System 201 is further provided with a lid 209 pivotally attached to body 203 and configured to secure the contents carried within the plurality of tubes 205 in a fixed position and maintain a desired cooling temperature.

Figure 3:
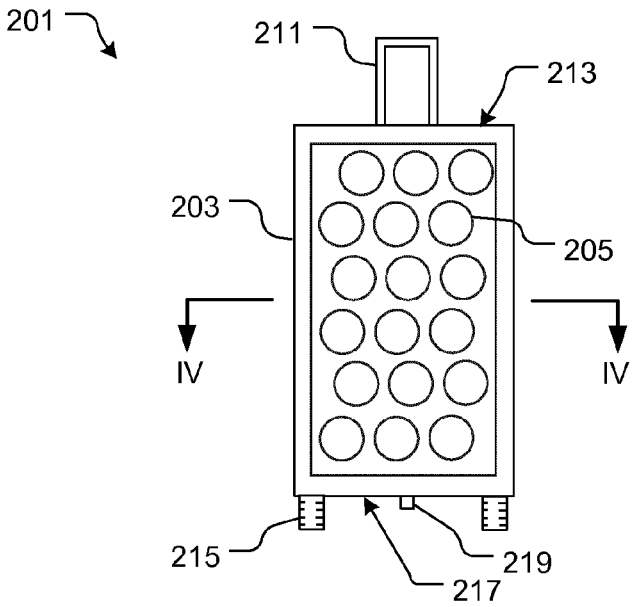
FIG. 3 is a front view of the cooler of FIG. 2.

As depicted in FIG. 3, system 201 is also optionally provided with a telescopic handle 211 extending from a top surface 213, one or more wheels 215 attached to bottom surface 217, and a plug 219 in fluid communication with cavity 401 and extending from bottom surface 217. During use, the handle and wheels assist in mobility of the cooler system, while plug 219 allows fluid release from cavity 401.

Figure 4:
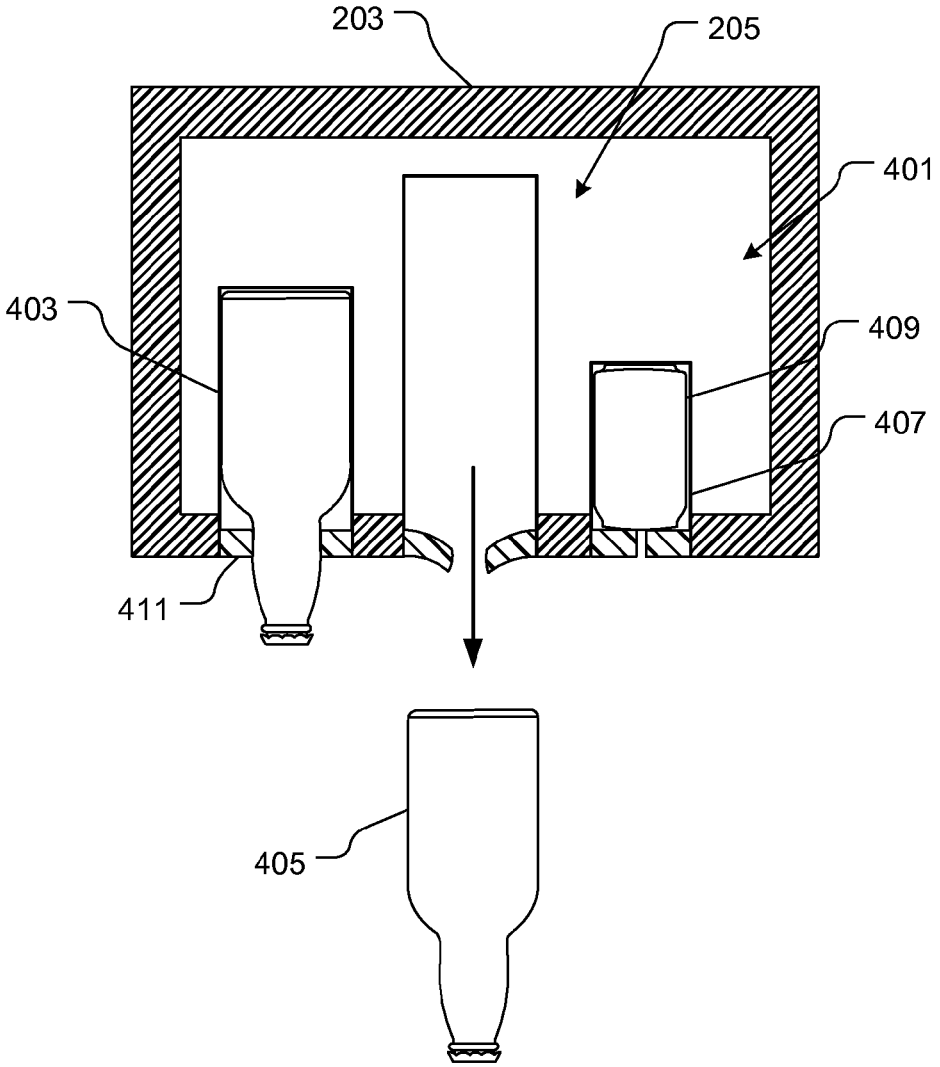
FIG. 4 is a cross-sectional view of the cooler of FIG. 3 taken at IV-IV.

Referring now to FIG. 4 in the drawings, a cross-sectional top view of system 201 is shown taken at IV-IV of FIG. 3. As discussed, body 203 forms a fluidly sealed cavity 401 configured to store, for example, ice therein to retain the items carried within the plurality of tubes 205 in a chilled state. In the exemplary embodiment, tubes 205 include different shapes and sizes. For example, the plurality of tubes 205 could include an elongated tube 403 configured to receive a bottle 405 partially therein, while tube 407 could be much smaller and could be configured to carry a soda can 409 therein. Larger sized tubes are also contemplated to carry the entire bottle 405. In the exemplary embodiment, tube 403 is sized to carry the bottle to the neck portion, thus allowing the user to quickly identify the type of beverage being stored.

One or more retaining devices 411 are attached at the entrance of each tube and configured to retain the beverage therein. In the contemplated embodiment, device 411 is an elastic material that elastically deforms as sufficient force is applied thereto, for example, as a user pulls a bottle from the tube. Other retaining means are also contemplated in alternative embodiments.

Although shown as cylindrical tubes configured to carry beverages therein, it is also contemplated having other shapes and sizes, e.g., a rectangular tube embodiment configured to store food items such as, for example, sandwiches.

One of the unique features believed characteristic of the present application is the ability to separate the fluidly sealed cavity 401 form the items being chilled via the tubes. Thus, the tubes act as fluid barriers, thereby preventing the contents therein from getting wet. This is particularly desired in situations wherein the food is destroyed by water, e.g., soggy sandwiches.

Another unique advantage believed characteristic of the present application is the ability to quickly locate the beverage of choice without having to sift through a pool of ice water. The tubes organize the beverages in such a manner that each beverage is quickly seen as the cooler system lid is opened. In the preferred embodiment, the body and lid are composed of an elastomeric material that provides sufficiently insulation to retain the beverages at a chilled temperature. However, it is also contemplated utilizing different types of material in alternative embodiments, for example, a lid composed of a transparent material. In this contemplated embodiment, the brands of the beverages can be seen through the lid in lieu of having to open the lid for visibility.

Figure 5:
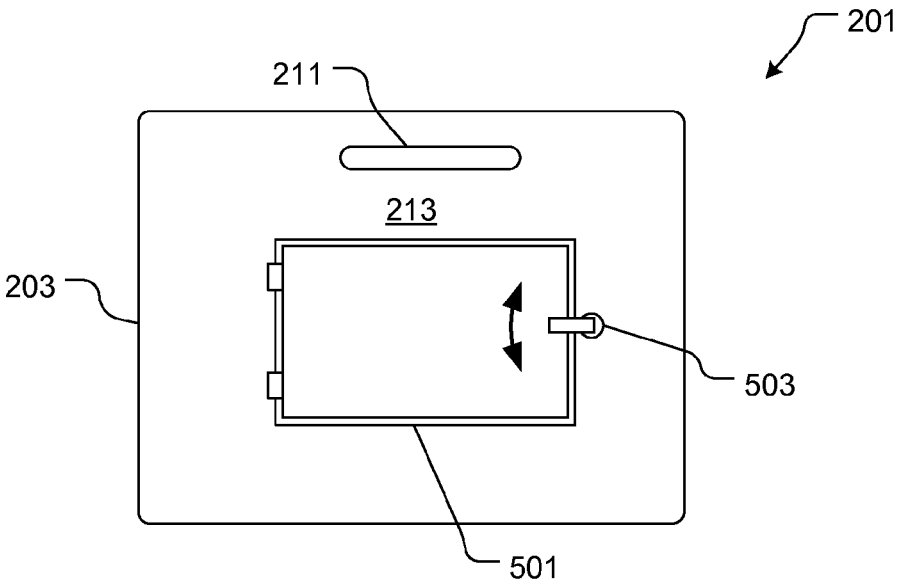
FIG. 5 is a top view of the cooler system of FIG. 2.
Figure 6:
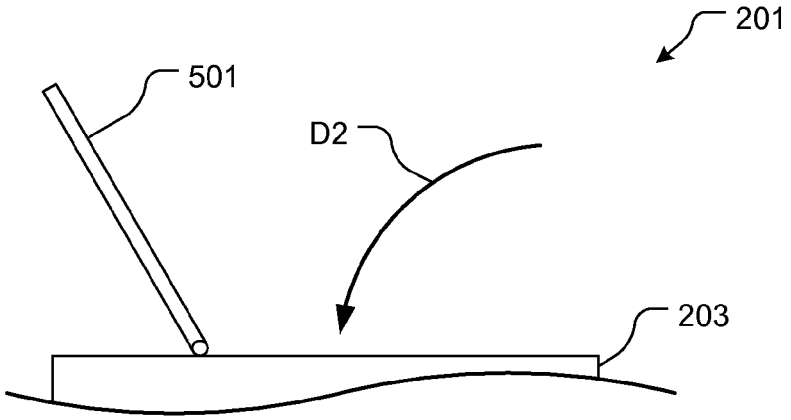
FIG. 6 is a partial front view of the cooler system of FIG. 5.

FIGS. 5 and 6 illustrate the top view of cooler system 201. It is contemplated utilizing a door 501 pivotally attached to top surface 213 and configured to secure to surface 213 via a latch 503. During use, the user will open door 501 and place the ice in cavity 401, which in turn will lodge between the outer surfaces of the plurality of tubes. After use, the door 501 is secured in a locked positioned via latch 503. As the ice melts and as water accumulates, the user opens plug 219 for drainage.

Figures 7A, 7B, 7C:
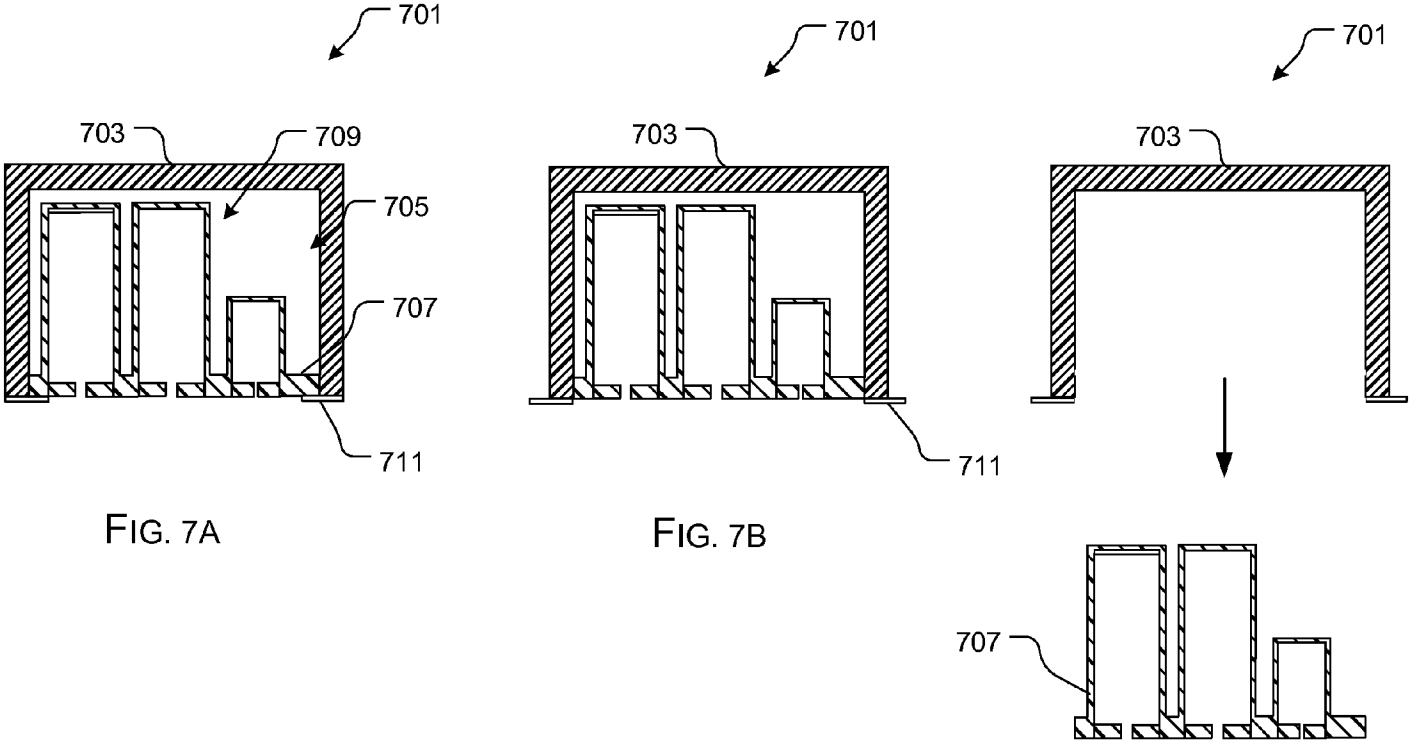
FIGS. 7A-7C are a cross-sectional views of a cooler system in accordance with an alternative embodiment of the present application.

In FIGS. 7A-7C in the drawings, top cross-sectional view of an alternative embodiment is shown. System 701 is substantially similar in form and function to system 201 and incorporates the features discussed herein.

System 701 includes a body 703 that forms a fluidly sealed cavity 705 configured to receive ice therein. Like cavity 401, cavity 705 is configured to is separated from the beverages via one or more tubes 709, which in turn is fixedly attached to an insert 707.

One unique feature believed characteristic of system 701 is the ability to remove insert 707 from the fluid cavity 705 during non-use and/or cleaning of the cavity. To achieve this feature, the insert is held in position via one or more fasteners 711 secured to body 703. This feature also allows for existing cooler systems to be retrofitted with the features of system 201 discussed herein.

Figure 8:
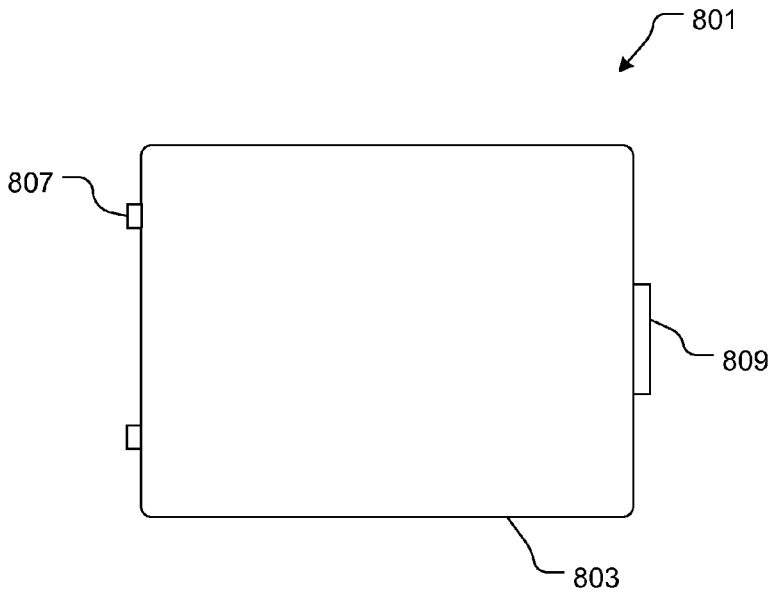
FIG. 8 is a top view of a cooler system in accordance with an alternative embodiment of the present application.
Figure 9:
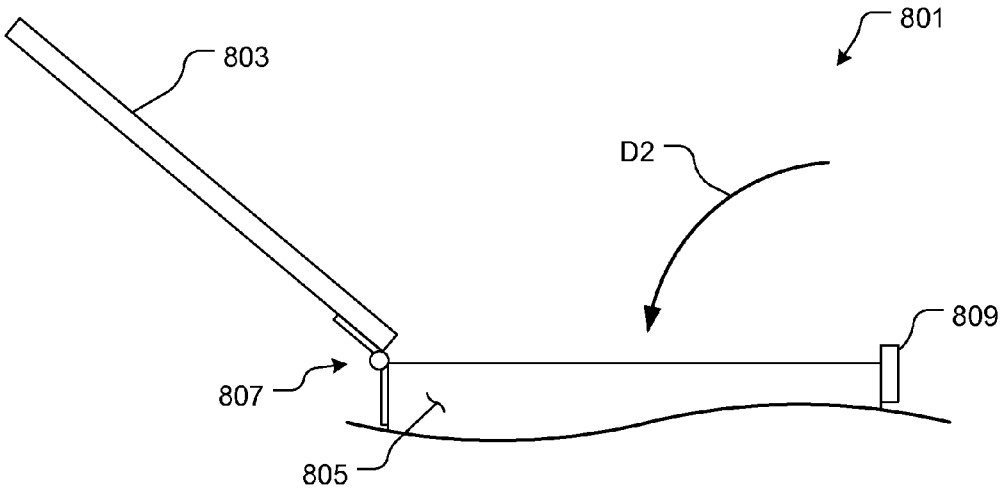
FIG. 9 is a partial front view of the cooler system of FIG. 8.

Referring now to FIGS. 8 and 9 in the drawings, a top view of a cooler system 801 is shown in accordance with an alternative embodiment of the present application. It will be appreciated that the features discussed herein with respect to system 201 are hereby incorporated with system 801. Thus, system 801 is substantially similar in form and function to system 201.

In the exemplary embodiment, system 801 includes a lid 803 pivotally attached to a body 805 via one or more hinges 807. A fastening device 809 is utilized to secure the lid 803 to the body 805. During use, the user will place ice and/or other cooling means within the interior cavity by opening lid 803, as indicated by arrow D2. In this contemplated embodiment, the user has a greater opening to place the ice within the interior cavity that previously discussed embodiments.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. An ice cooler system, comprising:

a body having a front wall forming an opening and an integral top wall, the body being configured to form a fluidly sealed cavity;

a removable insert sized to snugly fit within the opening of the front, the removable insert having a first row of tubes and a second row of tubes which are submerged within the fluidly sealed cavity, the first row and the second row of tubes being configured to receive beverages, the removable insert having a front surface that is positioned flush with the front wall of the body;

a first fastener slidingly engaged with the front wall and a second fastener slidingly engaged with the front wall, the first fastener and the second fastener being configured to secure the removable insert in a fixed position; and a door pivotally attached to the top wall of the body and in fluid communication with the fluidly sealed cavity;

wherein the door is configured to allow ice to pass therethrough to the fluidly sealed cavity.

2. The system of claim 1, further comprising:

a lid pivotally attached to the front wall of the body and configured to close over the first row and the second row of tubes;

wherein the lid secures beverages stored within the first row and second row of tubes in a fixed position.

3. The system of claim 1, further comprising:

a retaining device secured to the first row and the second row of tubes;

wherein the retaining device is configured to retain beverages stored within the first row and the second row in a fixed position.

4. The system of claim 1, wherein the first row of tubes is offset in position from the second row of tubes.

* * * * *